US011076649B2

(12) United States Patent
Iacono

(10) Patent No.: US 11,076,649 B2
(45) Date of Patent: Aug. 3, 2021

(54) GLOVE

(71) Applicant: Zero Friction, LLC, Oakbrook Terrace, IL (US)

(72) Inventor: John R. Iacono, Elmhurst, IL (US)

(73) Assignee: ZERO FRICTION, LLC, Oakbrook Terrace, IL (US)

( * ) Notice: Subject to any disclaimer, the term of this patent is extended or adjusted under 35 U.S.C. 154(b) by 246 days.

(21) Appl. No.: 16/444,199

(22) Filed: Jun. 18, 2019

(65) Prior Publication Data

US 2020/0397075 A1 Dec. 24, 2020

(51) Int. Cl.
*A41D 19/015* (2006.01)
*A41D 19/00* (2006.01)

(52) U.S. Cl.
CPC ... *A41D 19/01558* (2013.01); *A41D 19/0065* (2013.01); *A41D 2600/20* (2013.01)

(58) Field of Classification Search
CPC ..... A41D 19/01523; A41D 19/01558; A41D 19/0065; A41D 19/01576; A41D 2600/20; A63B 71/146
USPC ..... 2/161.1, 161.6, 163, 169
See application file for complete search history.

(56) References Cited

U.S. PATENT DOCUMENTS 2,226,604 A 12/1940 Geissmann
2,488,416 A 11/1949 Kurz
2,707,283 A 5/1955 Silver et al.
6,154,885 A 12/2000 Kobayashi et al.
6,216,276 B1 4/2001 Elbert
6,405,380 B1 6/2002 Kuroda et al.
6,415,445 B1 7/2002 Nishijima et al.
6,760,924 B2 * 7/2004 Hatch ..... A41D 19/01558 2/161.5
7,536,730 B2 5/2009 Estrella
7,882,571 B2 2/2011 Robba et al.
8,863,317 B2 10/2014 Tsuru et al.
8,950,015 B2 * 2/2015 Gibby ..... A41D 13/0156 2/161.1
9,656,150 B2 5/2017 Tan
(Continued)

FOREIGN PATENT DOCUMENTS

CN 209060499 U 7/2019
JP 2003334272 A 11/2003

OTHER PUBLICATIONS

A search and examination report issued by the Intellectual Property Office of the United Kingdom dated Jun. 23, 2020 in connection with Application No. GB1919201.2.

(Continued)

*Primary Examiner* — Katherine M Moran
(74) *Attorney, Agent, or Firm* — Baker & McKenzie

(57) ABSTRACT

A glove that is adaptable to conform to hands of various sizes is presented. The glove includes one or more stretchable gussets and an edge panel that connect a back-side to a palm-side of the glove. A thenar panel on the palm-side is coupled to portions of the one or more gussets and to portions of the edge panel. The one or more gussets are also attached to a wrist panel that includes a closure element on the back-side of the glove. A finger panel on the back-side of the glove is coupled to portions of the one or more gussets and to portions of the edge panel. A palm section on the palm side and a back section on the back-side include one or more stretch materials that improve the fit of the glove.

20 Claims, 7 Drawing Sheets

(56) References Cited

U.S. PATENT DOCUMENTS

| | | | |
|---|---|---|---|
| 10,111,477 | B1 | 10/2018 | Ballas |
| 2006/0026738 | A1 | 2/2006 | Kleinert |
| 2007/0083968 | A1 | 4/2007 | Stokes |
| 2007/0174948 | A1 | 8/2007 | Robba et al. |
| 2007/0226873 | A1 | 10/2007 | Mattesky |
| 2008/0109934 | A1 | 5/2008 | Widdemer et al. |
| 2010/0077526 | A1 | 4/2010 | Smeltzer |
| 2010/0186142 | A1 | 7/2010 | Kume et al. |
| 2010/0275342 | A1 | 11/2010 | Sweeney et al. |
| 2012/0227155 | A1 | 9/2012 | Brown |
| 2013/0152272 | A1 | 6/2013 | Schultz |
| 2013/0263356 | A1 | 10/2013 | Jones et al. |
| 2014/0143926 | A1 | 5/2014 | Brown et al. |
| 2015/0121598 | A1 | 5/2015 | Mathews et al. |
| 2016/0101342 | A1 | 4/2016 | Iacono |
| 2016/0286876 | A1 | 10/2016 | Iacono |

OTHER PUBLICATIONS

An International Search Report and Written Opinion of the International Searching Authority dated Sep. 23, 2020 in connection with International patent application No. PCT/US2020/037057.

* cited by examiner

GLOVE

BACKGROUND

Gloves are generally worn by many people for different reasons. For instance, athletes, construction workers, freight handlers, carpenters, and some farmers wear gloves to reduce blistering on their hands due to the nature of their respective crafts. Other individuals wear gloves to improve their grip on objects or on equipment they handle, such as in golf, baseball and other sporting activities. Gloves are also worn by some for protection from heat and cold environments or objects.

Work gloves in particular have become valuable to people in most industries due to the protection as well as other safety benefits they provide. However, most existing work gloves have several limitations that make their use difficult, and sometimes, uncomfortable for most people. For example, most existing gloves do not fit well and are not adaptable to conform to hands of various sizes. As a result, different sized work gloves are produced for different hand sizes. However, even with the different sized work glove options, some users still have difficulty finding a glove that fits well. Additionally, the hands of some users may change overtime (e.g., losing or gaining weight can cause such a change) leading to such users having the need to find new work gloves that account for the changes in their physiology.

Furthermore, although some work gloves are padded to provide a reinforced glove body that protects a person's hands from cold, heat, and from blistering, these gloves are often bulky due to the padding and are usually unwieldy to use as they limit the gripping features of such work gloves. Additionally, such work gloves are often aesthetically diminished due to the various safety features embedded into their design.

Moreover, some work gloves can add an extra layer of weight to a person's hands due to the materials (e.g., excess padding) used to create such gloves. This is particularly undesirable for applications requiring the user to handle heavy objects with gloves that are already heavy to begin with.

Moreover, some work gloves are not adaptable for use with multiple applications or tasks. Thus, a user would often have to buy multiple work gloves for different applications. This is not only costly to the user but also, can create clutter in a user's workspace especially when the user does not have time to organize his workspace with the plurality of work gloves purchased by the user lying around in the same workspace.

Retailers also have the problem of stocking a variety of work gloves having different sizes for different work applications. This may lead to the retailers having a surplus when the retailers are unable to sell work gloves designed for certain applications and/or work gloves having certain sizes. Further, numerous sizes of a variety of work gloves for men and for women may require a large amount of shelf space and/or hanging rack space to display every available size of work glove. Retailers may have limited shelf space and may be unable to carry such a large variety of work gloves in all of the available sizes.

Additionally, the focus on safety alone in the design of some work gloves can lead to the creation of work gloves that have low breathability. Such gloves do not allow ones hands to "breath" appropriately during use. Consequently, a user often finds his/her hands sweating without having appropriate glove structures that can efficiently wick away the sweat by pulling the sweat from the hands towards an exterior of the glove to dry. While some work gloves have a moisture-wicking liner for handling sweat, such gloves are often bulky and lead to some of the problems associated with bulky gloves discussed above.

Moreover, most work gloves lack flexibility. This makes it difficult to freely move one's fingers and wrists in such gloves. In some cases, such gloves restrict certain hand motions and thus make it hard to perform precision tasks requiring discrete functions such as gripping and turning a small object (e.g., a small screw), wiggling one's fingers, and typing while working on projects requiring a work glove.

BRIEF SUMMARY

According to one aspect of the subject matter described in this disclosure, a glove that is adaptable to conform to hands of various sizes is presented. The glove has a palm-side and a back-side joined to the palm-side. In one embodiment, the glove includes a thenar panel on the palm-side extending into a thumb finger part, an index finger part, a middle finger part, a ring finger part, and a pinky finger part. Additionally, a hypothenar panel including a padded region and a palm panel bounding the hypothenar panel and the thenar panel are also included in the glove on the palm-side. The glove also includes an edge panel connecting the palm-side to the back-side between the thumb finger part and the index finger part. A wrist panel attached to a first portion of the palm panel and to a first portion of the thenar panel on the palm-side is also included in the glove. At least a section of the wrist panel is attached to a closure element on the back-side of the glove. Further, a gusset including an expandable material joins the palm-side to the back-side. In some cases, the gusset is attached on the palm-side to: a first portion of the hypothenar panel, a second portion of the thenar panel, and a second portion of the palm panel.

In some embodiments, the glove, on the back-side, includes a finger panel, a back padding, a back section, a wrist panel, a median panel, and a pollicis panel. The finger panel includes a first portion with an index finger part, a second portion with a middle finger part, a third portion with a ring finger part, and a fourth portion with a pinky finger part. The back padding can be stitched or otherwise attached to the finger panel at a first side of the back padding. The back section can be secured to a second side of the back padding. The median panel may be secured to a first side of the back section and to a first section of the wrist panel. The pollicis panel provides a fifth portion with the thumb finger part and extends from the back-side to a portion of the palm-side. In some instances, the pollicis panel is secured to a second section of the wrist panel and to one or more portions of the edge panel.

These and other implementations may each optionally include one or more of the following features. The thumb finger part includes a first grip panel on the palm-side. The index finger part includes a second grip panel on the palm-side while the middle finger part includes a third grip panel on the palm-side. On the back-side, the first portion with the index finger part is attached to a first nail panel while the second portion with the middle finger part is attached to a second nail panel. Moreover, the third portion with the ring finger part is attached to a third nail panel and the fourth portion with the pinky finger part is attached to a fourth nail panel. The fifth portion with the thumb finger part is attached to a fifth nail panel.

In some implementations, the second grip panel includes a first textured surface that is different from a second textured surface of the first grip panel and is different from a third textured surface of the third grip panel. In some embodiments, the second grip panel may be configured to be compatible with a capacitive touchscreen.

In one embodiment, the glove includes a palm section at a boundary between the palm panel and the thenar panel. The thenar panel and the palm panel may be respectively stitched to the palm section at the boundary. Moreover, the palm section extends from the wrist panel on the palm-side in a direction of the index finger part and towards a direction of a bottom portion of the pinky finger part. In some embodiments, the palm section includes a stretchable material that is different from a first material of the thenar panel and different from a second material of the palm panel.

In some embodiments, the padded region of the hypothenar panel is configured to absorb vibrations when the glove comes into contact with a vibratory object.

In some instances, the first nail panel on the back-side includes a textured surface that is similar to a textured surface of one or more grip panels on the palm-side of the glove.

In one embodiment, the back section includes stretchable material that is different from a first material of the finger panel, a second material of the back padding, a third material of the median panel, and a fourth material of the pollicis panel. The pollicis panel may include a material that is different from a first material of the finger panel.

In some embodiments, the gusset comprises a first gusset connecting a first portion of the palm-side to the back-side, and a second gusset connecting a second portion of the palm-side to the back-side. The first gusset may be attached to a third section of the wrist panel and to a first portion of the edge panel with the first gusset being continuous from the third section of the wrist panel to the first portion of the edge panel. Moreover, the second gusset may be attached to a fourth section of the wrist panel and to a second portion of the edge panel with the second gusset being continuous from the fourth section of the wrist panel to the second portion of the edge panel.

Additional features and advantages of the present invention are described in, and will be apparent from, the detailed description of this disclosure.

BRIEF DESCRIPTION OF THE DRAWINGS

The disclosure is illustrated by way of example, and not by way of limitation in the figures of the accompanying drawings in which like reference numerals are used to refer to similar elements. It is emphasized that various features may not be drawn to scale and the dimensions of various features may be arbitrarily increased or reduced for clarity of discussion.

DETAILED DESCRIPTION

The present disclosure relates to a glove that is designed to conform to various hand sizes. The glove may be an athletic glove for a variety of sports such as golf, racquetball, baseball, football, snow skiing, water skiing, weightlifting and the like. The glove may also be used as a work glove for a variety of tasks such as building or road construction, freight handling, carpentry, farming, plumbing, parts assembly, and parts machining.

In one embodiment, the glove includes one or more stretchable features that allow the glove to expand or contract in order to comfortably fit different hand sizes. This reduces the need for a user to change gloves even when there are physiological changes to the user's hands. The stretchable features of the glove also increase the flexibility of the glove when worn so that a user of the glove can perform precision tasks as well as other nimble actions with the glove still on. In some embodiments, the glove includes vibration absorptive padding that reduces shock effects on the hands when in contact with a vibratory object. The vibration absorptive padding, as well as other safety features of the glove is designed with materials that make the glove less bulky and aesthetically appealing without effecting the safety considerations of a user/wearer. In some instances, the glove described in this disclosure can be used in multiple different applications.

Figure 1:
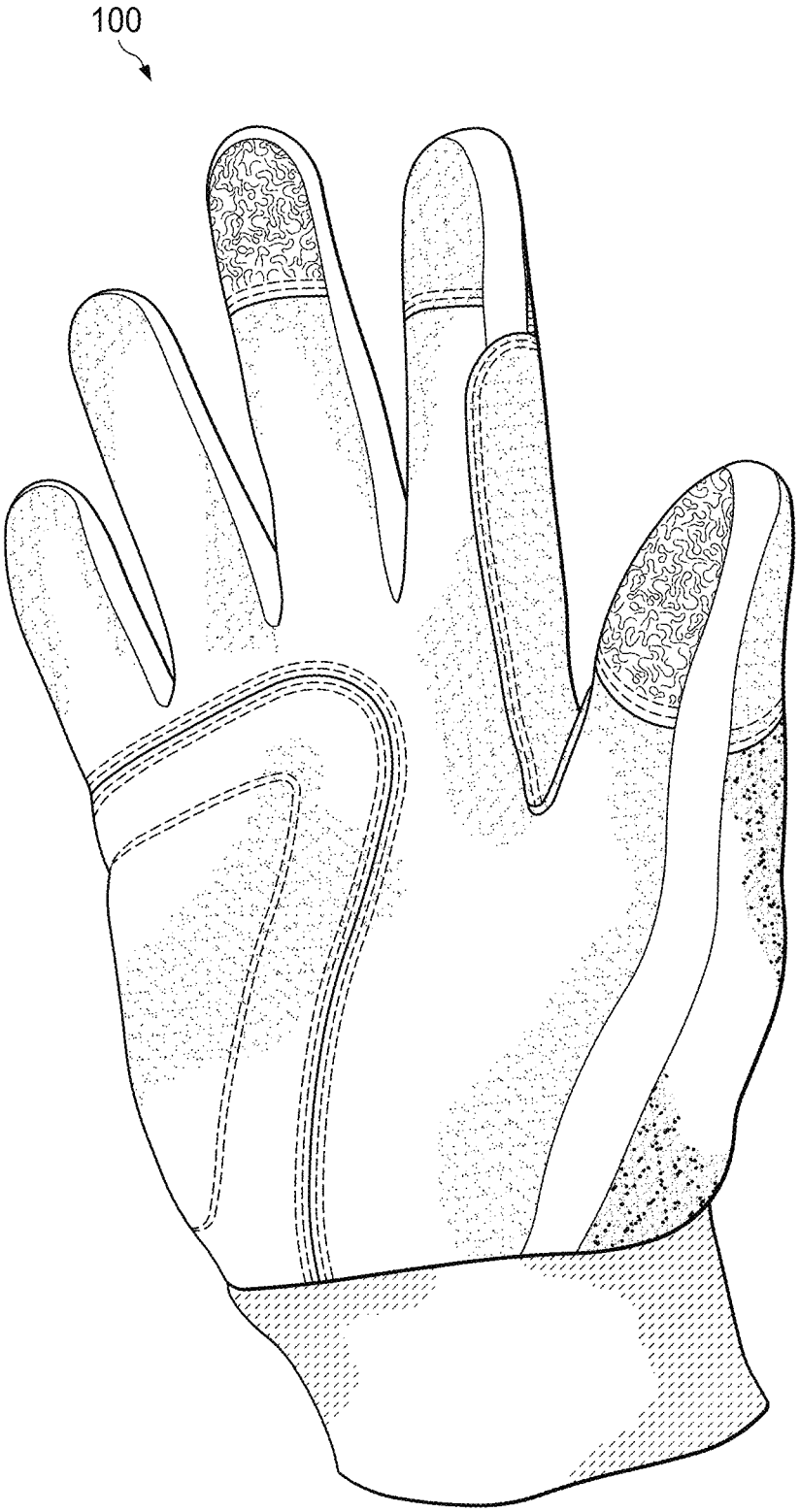
FIG. 1 illustrates an example perspective view of a glove, according to one embodiment of this disclosure.

FIG. 1 illustrates an example perspective view of a glove 100. As seen more clearly on the palm-side 200 of the glove 100 in FIG. 2, the glove 100 includes a thenar panel 202, a hypothenar panel 204, a palm panel 206, an edge panel 208, and a wrist panel 210 on the palm-side 200. Additionally, the glove 100 includes a gusset 212 (e.g., 212*a* and/or 212*b*) that connects the palm-side 200 to a back-side 300 (see FIG. 3) as further discussed below.

The thenar panel 202 may be configured to protect, among other things, the thenar eminence regions of the palm of a user as well as portions of the thumb 214, portions of the index finger 216, portions of the middle finger 218, portions of the ring finger 220, and portions of the pinky finger 222 on the palm-side 200. In one embodiment, the thenar panel 202 extends into a thumb finger part 213, an index finger part 215, a middle finger part 217, a ring finger part 219, and into a pinky finger part 221 as seen in the figure. The thumb finger part 213, the index finger part 215, the middle finger part 217, the ring finger part 219, and the pinky finger part 221 are sections or regions associated with the thumb 214, the index finger 216, the middle finger 218, the ring finger 220, and the pinky finger 222 of the glove 100, respectively. In some cases, the thenar panel 202 is attached to one or more parts, sections, panels, etc., of the glove 100. For example, the thenar panel 202 may be attached to portions of the wrist panel 210, to portions of the gusset 212, and to portions or sections of the edge panel 208.

Additionally, the thenar panel 202 may also be attached to one or more grip panels corresponding to sections of the thumb finger part 213, the index finger part 215, the middle finger part 217, the ring finger part 219, and the pinky finger part 221. In the illustrated embodiment, the thenar panel 202 may be attached to a first grip panel 224 associated with the thumb finger part 213, to a second grip panel 226 associated with the index finger part 215, and to a third grip panel 228 associated with the middle finger part 217. In one embodiment, the first grip panel 224, the second grip panel 226, and the third grip panel 228 are designed with materials that enhance the gripping power of the glove 100 by increasing friction between the glove 100 and an object being held with the glove 100. In some cases, these grip panels also provide an added layer of protection for the regions around the thumb 214, the index finger 216, and the middle finger 218 on the palm-side 200. The first grip panel 224, the second grip panel 226, and the third grip panel 228 may be fabricated with similar or dissimilar textured surfaces and/or materials. For example, the second grip panel 226 may include a first textured surface that is different from a second textured surface of the first grip panel 224 and is different from a third textured surface of the third grip panel 228. In some implementations, one or more of the textured surfaces associated with the first grip panel 224, the second grip panel 226, and the third grip panel 228 may be compatible with electronic displays such as capacitive touchscreens. For instance, the second grip panel 226 may be configured to be compatible with a capacitive touchscreen thus allowing a user to interact with the capacitive touchscreen without removing the glove 100.

In one embodiment, the first grip panel 224, and/or the second grip panel 226, and/or the third grip panel 228 enhance the bending of the distal phalanx/phalange associated with the thumb 214, the index finger 216, and the middle finger 218 towards the center of the palm of a user with the glove 100 on. This is particularly advantageous in applications such as gripping a circular or cylindrical object, typing, and performing certain hand gestures (e.g., come-hither sign).

Additionally, the thenar panel 202 may be attached to one or more parts of the glove in a manner that increases flexible movement of the thumb 214 and/or the index finger 216, and/or the middle finger 218, and/or the ring finger 220, and/or the pinky finger 222. For example, in the illustrated embodiment of FIG. 2, the thenar panel 202 is attached to the palm section 230 (which is discussed below) with a stitch pattern that proceeds from the wrist panel 210 towards the index finger part 215 and arches towards the bottom portion 231 of the pinky finger part 221. This particular stitch pattern effectively isolates the thumb 214 and at least the index finger 216, the middle finger 218, the ring finger 220, and the pinky finger 222 for ease of movement. The shape of the stitch pattern used to join the thenar panel 202 to the palm section 230 breaks the continuity of the material used to design the thenar panel 202. This breakage in material continuity of the thenar panel 202 provides isolation needed to enhance flexible movement of the thumb 214, and/or the index finger 216, and/or the middle finger 218, and/or the ring finger 220, and/or the pinky finger 222.

The palm panel 206 and the hypothenar panel 204 may be designed to at least protect the middle regions of a user's palm as well as protect the hypothenar eminence regions of the user's palm. To accomplish this, the hypothenar panel 204 and/or the palm panel 206 may include one or more padded regions, one or more vibration absorptive padding, one or more attachment patterns/stitch patterns, etc. For example, the hypothenar panel 204 and/or the palm panel 206 may include one or more vibration absorptive padding and/or other padded regions that absorb vibrations when the glove comes into contact with a vibratory object. In such instances, the materials used for the padded regions and/or the vibration absorptive padding can be made from light-weight silicone rubber, latex, leather, etc. In some cases, the vibration absorptive padding protects the user's hands from harmful shock effects resulting from handling equipment and/or objects that vibrate. In some embodiments, the palm panel 206 is attached to portions of the wrist panel 210 and to portions of a palm section 230 of the glove 100.

In some instances, the hypothenar panel 204 and/or the palm panel 206 may include a leather (e.g., goat leather) reinforcement, and/or a polyurethane coating, and/or a nitrile coating to ensure that the glove 100 is abrasion resistant, wear resistant, cut resistant, heat resistant and/or cold resistant. This is particular advantageous in applications requiring handling sharp objects, cold/hot objects, etc., using the palm of the user. Additionally, such reinforcement also protects the palms (particularly the thenar eminence regions of the palm) from getting bruised, burnt, or otherwise callused due to high impact activities involving the palm of the user.

Figure 2:
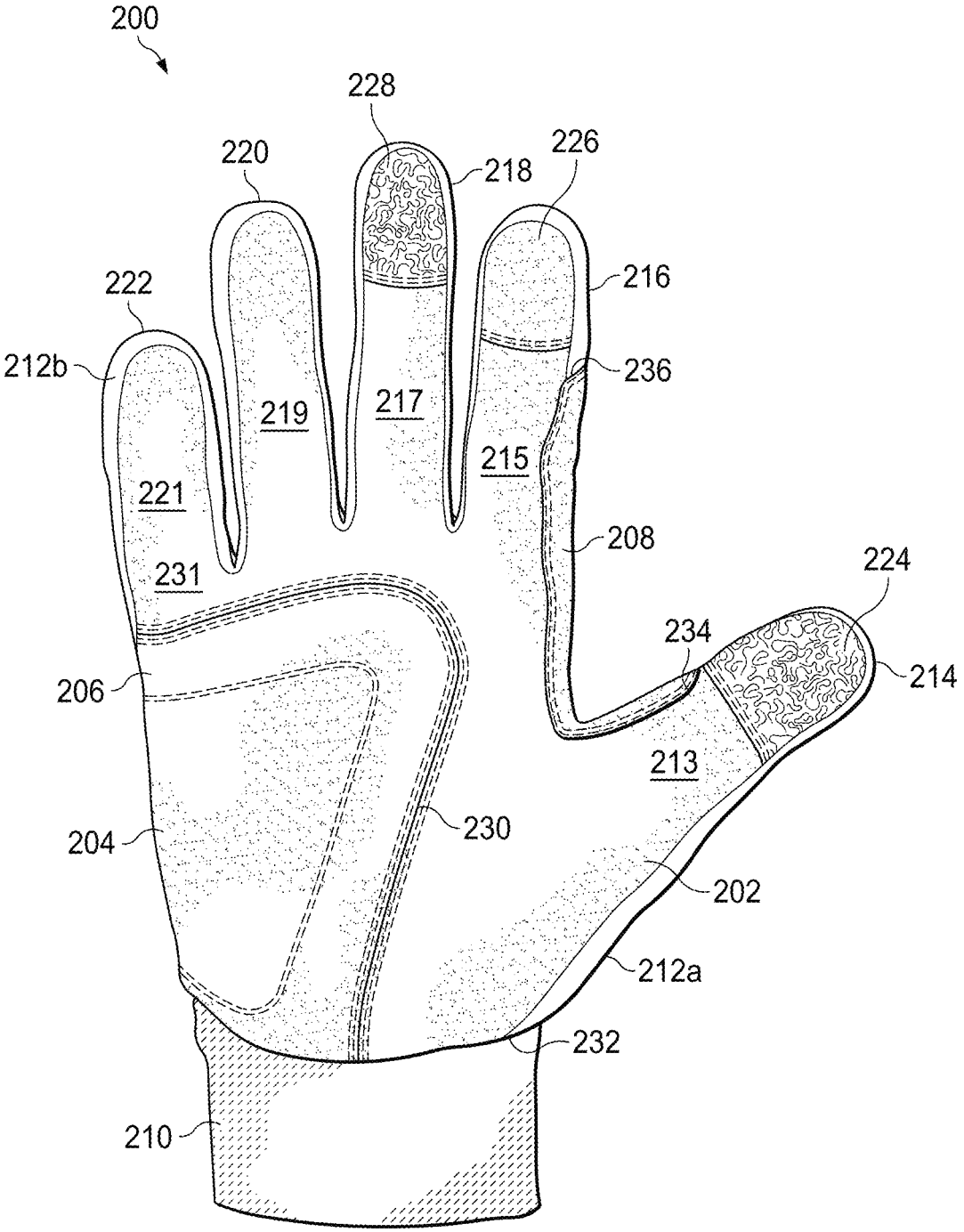
FIG. 2 depicts an example palm-side of the glove of FIG. 1.

The palm section 230 may be located at a boundary between the palm panel 206 and the thenar panel 202 such that the thenar panel 202 and the palm panel 206 are respectively attached to the palm section 230 at the boundary. In the embodiment shown in FIG. 2, the palm section 230 extends from the wrist panel 210, to which it is attached on the palm-side 200, in a direction of the index finger part 215 and towards a direction of a bottom portion 231 of the pinky finger part 221. In some cases, the palm section 230 includes a stretchable material that is different from a first material of the thenar panel 202 and is different from a second material of the palm panel 206. The stretchable material associated with the palm section 230 allows the glove 100 to expand and/or contract in the palm regions as needed. This further improves the fit of the glove 100. Additionally, the palm section 230 may also include one or more moisture absorption materials that wick away sweat or other moisture from a user's palm to an exterior of the glove 100. The particular shape of the palm section 230 illustrated in FIG. 2 provides advantages in the context of a sports glove and work glove. A tool or piece of sporting equipment (e.g., a bat or a club), comes into contact with the hyopthenar portion of the hand. The arcuate shape with an apex towards the thumb side allows for the hypothenar panel 204 to be more continuous in the region where the tool or sporting equipment contacts the hand. This may provide better grip, more protection, and better vibration resistance. This arcuate shape may also improve the ruggedness of the glove by reducing abrasion between the tool or sporting equipment and the stretchable material of the palm section 230.

While the embodiment shown in FIG. 2 indicates that the edge panel 208, the palm panel 206, the hypothenar panel 204, and the thenar panel 202 can have similar textured surfaces, this is not limiting. For example, the edge panel 208 may have a textured surface that is different from a textured surfaces associated with the palm panel 206, and/or the hypothenar panel 204, and/or the thenar panel 202. In some embodiments, the edge panel 208, the palm panel 206, the hypothenar panel 204, and the thenar panel 202 may include other materials for reinforcement such as a leather patch or the like. In some cases, the edge panel 208, the palm panel 206, the hypothenar panel 204, and the thenar panel 202 may be designed using materials such as suede and/or expandable microfiber. In other instances, the edge panel 208, the palm panel 206, the hypothenar panel 204, and the thenar panel 202 may be fabricated from leather, and/synthetic leather, and/or a blend of polyester and polyurethane, and/or a combination thereof. In some embodiments, the edge panel 208, the palm panel 206, the hypothenar panel 204, and the thenar panel 202 may be designed with materials that are heat and/or cold resistant. In some instances, the edge panel 208, the palm panel 206, the hypothenar panel 204, and the thenar panel 202 can also be fabricated to insulate a user's hand from electric charges.

In one embodiment, portions of the thenar panel 202 and/or portions of the hypothenar panel 204, and/or portions of the palm panel 206 may include a silicone layer configured to improve grip and reduce impact from high velocity objects on the palm of a user wearing the glove 100. Applications where such configurations are beneficial include a football receiver wearing the glove 100 and catching a pass, a goalie wearing the glove 100 and swatting away a moving soccer ball with the palm, a martial artist with the glove 100 on swatting away, using the palm, a kick or a punch from an opponent, etc. The silicone layer may be stitched into portions of the thenar panel 202, and/or stitched into portions of the hypothenar panel 204, and/or stitched into portions of the palm panel 206. The stitching of the silicone layer may be done in the glove interior 702 or directly onto exterior portions of one or more panels of the glove 100 on the palm-side 200. In some embodiments, the silicone layer may be attached to both the glove interior 702 and to exterior portions of the glove 100 on the palm-side 200 and/or back-side 300. It is noted that the grip panels discussed in association with the thumb 214, the index finger 216, and the middle finger 218 may also include a silicone layer configured for impact reduction as discussed in this disclosure.

As earlier mentioned, the edge panel 208 and the gusset 212 each connect portions of the palm-side 200 of the glove 100 to portions of the back-side 300 of the glove 100. On the palm-side 200, the edge panel 208 connects the palm-side 200 and the back-side 300 between the thumb finger part 213 and the index finger part 215. Structurally, the edge panel 208 provides material isolation of the thenar panel 202 on the palm-side 200 from one or more materials used to design the back section between the thumb 214 and the index finger 216. This material isolation provides for accommodation of high stress that can be experienced between the thumb 214 and the index finger 216 without significantly affecting the structural integrity of one or more materials used to build the glove on the palm-side 200 and the back-side 300.

In one embodiment, the edge panel 208 is attached to the thenar panel 202 on the palm-side 200 and to portions of the gusset 212. The gusset 212 may comprise, in some embodiments, a first gusset 212*a*, a second gusset 212*b*, etc. as needed, that attach portions of the palm-side 200 to the back-side 300. On the palm-side 200 for example, a first gusset 212*a* may be attached to a first section or portion 232 of the wrist panel 210 and to a first portion 234 of the edge panel 208 on the thumb finger part 213. In such embodiments, the first gusset 212*a* is continuous from the first portion 232 of the wrist panel 210 to the first portion 234 of the edge panel 208. A second gusset 212*b* may also connect portions of the palm-side 200 to the back-side 300. This second gusset 212*b* may be attached to a second section/portion 402 (see FIG. 4) of the wrist panel 210 and to portions 406 (see FIG. 4) of the thenar panel 202, portions 408 (see FIG. 4) of the palm panel 206, and to portions 410 (see FIG. 4) of the hypothenar panel 204. In some cases, a portion 412 (see FIG. 4) of the palm section 230 may also be attached to the second gusset 212*b* around the bottom portion 231 of the pinky finger part 221 as seen in FIG. 2. The second gusset 212*b* may be continuous from the second section 402 (see FIG. 4) of the wrist panel 210 to a second section 236 of the edge panel 208 on the index finger part 215.

It is appreciated that the first gusset 212*a* and the second gusset 212*b* may be made from one or more similar and/or dissimilar stretch materials that can expand and/or contract in order to further improve the conformity (e.g., the ability of the glove to fit a user's hand) of the glove 100 to hands of various sizes. For example, the first gusset 212*a* and/or the second gusset 212*b* may be wholly or partially fabricated from one or more stretch materials such as elastic materials and/or mesh materials, or the like, that can expand and/or contract. In some embodiments, the one or more stretch materials may allow for breathability of the glove 100. For example, the one or more stretch materials may allow heat and/or perspiration from inside the glove 100 to escape. In some embodiments, the one or more stretch materials may be made from nylon, Lycra, spandex, and/or the like or any combination of such materials.

Figure 3:
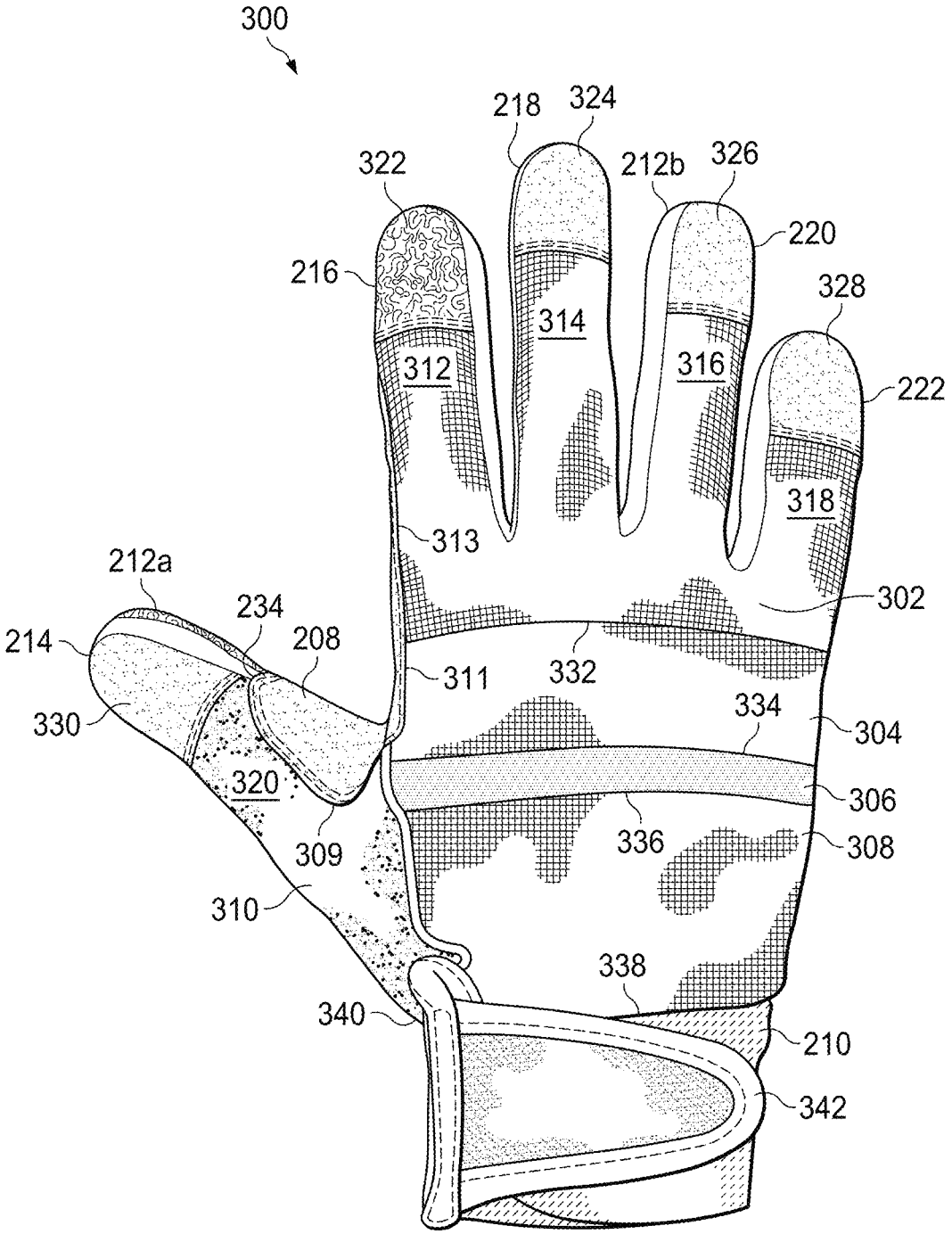
FIG. 3 depicts an example back-side of the glove of FIG. 1.

Turning to the back-side 300 of FIG. 3, the glove 100 also includes a finger panel 302, a back padding 304, a back section 306, a median panel 308, and a pollicis panel 310. The second gusset 212*b* discussed above may be attached to portions of the finger panel 302, to portions of the back padding 304, to portions of the back section 306, and to the median panel 308. The first gusset 212*a* may also be attached to sections of the pollicis panel 310 and to the first portion 234 of the edge panel 208. As seen in the figure, the portions of the pollicis panel 310 to which is attached the first gusset 212*a* extends into the palm-side 200 of the glove 100. Additionally, the edge panel 208 may be attached to portions 309 of the pollicis panel 310, to portions 311 of the back padding 304, and to portions 313 of the finger panel 302.

The finger panel 302 is designed to protect, for example, back sections of the index finger 216, back sections of the middle finger 218, back sections of the ring finger 220, and back sections of the pinky finger 222. In one embodiment, the finger panel 302 includes a first portion with the index finger part 312 on the back-side 300 and a second portion with the middle finger part 314 on the back-side 300. The finger panel also includes a third portion with the ring finger part 316 on the back-side 300 and a fourth portion with the pinky finger part 318 on the back-side 300. In some embodiments, one or more of the first portion with the index finger part 312, the second portion with the middle finger part 314, the third portion with the ring finger part 316, and the fourth portion with the pinky finger part 318 may be attached to one or more nail panels. The one or more nail panels offer another layer of protection for regions on and/or around a user's index fingernail, middle fingernail, ring fingernail, and pinky fingernail. For example, the first portion with the index finger part 312 can be attached to a first nail panel 322 and the second portion with the middle finger part 314 can be attached to a second nail panel 324. Similarly, the third portion with the ring finger part 316 can be attached to a third nail panel 326 while the fourth portion with the pinky finger part 318 can be attached to a fourth nail panel 328. One or more of the first nail panel, the second nail panel, the third nail panel, and the fourth nail panel can have a textured surface that is similar to a textured surface of the first grip panel 224 on the palm-side 200. In some instances, one or more of the first nail panel 322, the second nail panel 324, the third nail panel 326, and the fourth nail panel 328 can have a textured surface that is similar to a textured surface of the second grip panel 226, and/or a textured surface of the third grip panel 228 on the palm-side 200. For instance, the first nail panel 322 may include a textured surface that is similar to a textured surface of one or more grip panels (e.g., the first grip panel 224 and/or the third grip panel 228) on the palm-side 200.

The back padding 304 may be provided with a reinforced padding that protects a first area surrounding the metacarpals of a user's hand. Such padding can be made using lightweight materials like acrylic and/or merino wool, and/or silicone, or a combination thereof. In the illustrated embodiment, the back padding 304 may be disposed on the back-side and attached to the finger panel 302 at a first side 332 of the back-padding. Attached to a second side 334 of the back padding 304 is the back section 306. The back section 306 may be designed with a stretch material, such as those discussed above, in order to further improve the fitting features or the ability of the glove 100 to conform to hands of various sizes. In some embodiments, the back section 306 includes a stretch material that is different from a first material of the finger panel 302, a second material of the back padding 304, a third material of the median panel 308, and a fourth material of the pollicis panel 310. The median panel 308 is attached to the back section 306 at a first side 336 of the back section 306. Further, the median panel 308 is also attached to a section 338 of the wrist panel 210. More specifically, the median panel may be coupled to a first portion/section 338 of the wrist panel 210 and to a first section 404 (see FIG. 4) of the second gusset 212*b*. The median panel 308 may be designed to protect a second area surrounding the user's metacarpals as well as portions of the carpal bones of the user. In some cases, the median panel 308 is isolated from the back padding 304 by the back section 306 in order to improve the flexible hand movement during clenching of the hand into a first and outspreading of the fingers of the user wearing the glove 100. In some embodiments, the median panel 308 is made of a material that is similar to a material used to design/make the finger panel 302. In some embodiments, the median panel 308 and/or the finger panel 302 include materials that wick away moisture from within the glove 100 during use of the glove 100.

In one embodiment, portions of the finger panel 302 and/or portions of the back padding 304, and/or portions of the median panel 308 may include a silicone layer configured to provide grip and reduce impact from high velocity objects on portions of the back-side 300 of the glove 100. In a preferred embodiment, the silicone layer is included on the nail panels 322, 324, 326 and 328. Such glove configurations are beneficial in applications such as a cornerback wearing the glove 100 and swatting away a pass, a goalie wearing the glove 100 and swatting away a moving soccer ball with the back-side 300, a martial artist with the glove 100 on and swatting away, using the back-side 300, a kick or a punch from an opponent, etc. The silicone layer may be stitched into portions of the finger panel 302, and/or stitched into portions of the back padding 304, and/or stitched into portions of the median panel 308. The stitching of the silicone layer may be done in the glove interior 702 or directly onto exterior portions of the finger panel 302, and/or exterior portions of the back padding 304, and/or exterior portions of the median panel 308. In some embodiments, the silicone layer may be attached to both the glove interior 702 and to exterior portions of the glove 100 on the palm-side 200 and/or back-side 300. It is noted that the nail panels discussed in association with the thumb 214, the index finger 216, the middle finger 218, the ring finger 220, and the pinky finger 222 may include a silicone layer configured for impact minimization as discussed in this disclosure. Additionally, portions of the pollicis panel 310 and/or portions of the edge panel 208 may also include a silicone layer.

The pollicis panel 310 may be designed to ensure flexibility around the carpometacarpal joint of the thumb 214 as well as other areas around the user's thumb on the back-side 300. In some cases, the pollicis panel 310 may be fabricated to allow a user's thumb 214 to move with ease while the glove 100 is worn. This beneficially allows the user to stretch the thumb 214 and perform precision tasks (e.g., typing, etc.) with the glove still on without feeling restricted by the glove 100. In one embodiment, the pollicis panel 310 provides a fifth portion with the thumb finger part 320 and extends from the back-side 300 to a portion of the palm-side 200. The fifth portion with the thumb finger part 320 may be attached to a fifth nail panel 330. The fifth nail panel 330 may include one or more of the features discussed above in association with the first nail panel 322, the second nail panel 324, the third nail panel 326, and/or the fourth nail panel 328. In some embodiments, the first nail panel 322, the second nail panel 324, the third nail panel 326, the fourth nail panel 328, and the fifth nail panel 330 may include a material that limits moisture or other particulate matter from penetrating the glove 100 and thus adversely affecting the fingernails of the user. Materials used to design the finger panels shown may include, in some embodiments, ribbed nylon, spandex, synthetic leather, nitrile, and/or a combination thereof. Additionally, protection from nail related trauma can also be provided by the first nail panel 322, the second nail panel 324, the third nail panel 326, the fourth nail panel 328, and the fifth nail panel 330. Such trauma may include breakage of fingernails, splitting of fingernails, peeling of fingernails, chipping of fingernails, fingernail delamination, etc.

In some instances, the pollicis panel 310 is secured to a section 340 (also see FIG. 5) of the wrist panel and to one or more portions 309 of the edge panel 208. In some embodiments, the pollicis panel 310 includes a material that is different from materials used to make the finger panel 302 and/or the median panel 308.

The wrist panel 210 may be configured to stabilize the wrist of the user to prevent wrist sprains, wrist fractures, and wrist strains while the glove 100 is in use. In some embodiments, the wrist panel 210 allows the user to fasten or secure the glove 100 to the wrist of the user. The wrist panel 210 may also be adaptable to conform to wrists of various sizes depending on the user. This is due, in part, to the materials incorporated into the design of the wrist panel 210. As seen on the back-side 300, the wrist panel 210 includes a closure element 342. The closure element 342 may include, for example, a flap and a hook-and-loop closure. In some embodiments, the hook-and-loop closure may be a Velcro fastener. In some cases, the flap may have an elastic loop attached to it to improve flexible wrist movements of a user. The flap and hook-and-loop closure may allow tightening and/or loosening of the glove 100 as needed. It is appreciated that while the closure element 342 is depicted as being on the back-side 300, the closure element 342 can be on the palm-side 200 or at an area on the wrist panel 210 between the palm-side 200 and the back-side 300.

It is appreciated that portions of one or more panels, parts, or sections on the palm-side 200 and/or back-side 300 may include one or more vent holes that provide increased ventilation for the user's hands. More specifically, the vent holes allow, in addition to other breathability features of the glove 100, heat or perspiration from the user's hands to escape from the glove 100. In one embodiment, one or more vent holes are situated on portions of the finger panel 302. In other embodiments, one or more vent holes are positioned on portions of the thenar panel 202. Some embodiments have vent holes on sections of both the palm-side 200 and the back-side 300.

Figure 4:
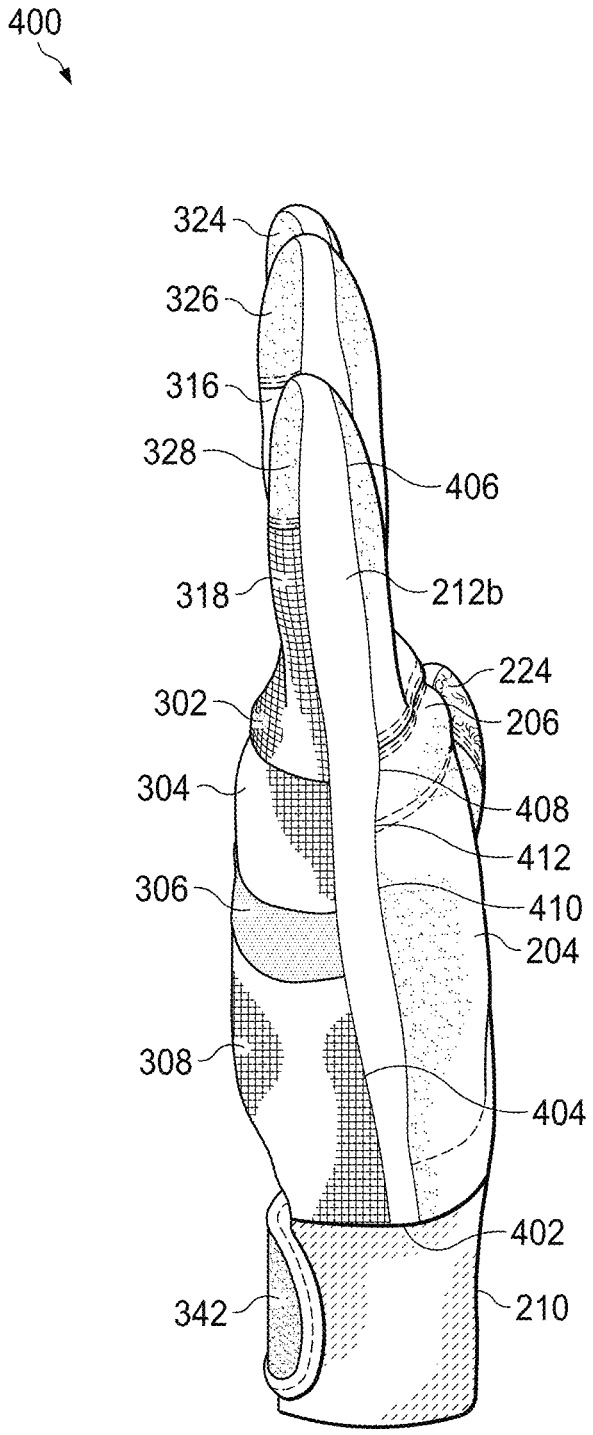
FIG. 4 illustrates an example first-edge view of the glove of FIG. 1.
Figure 5:
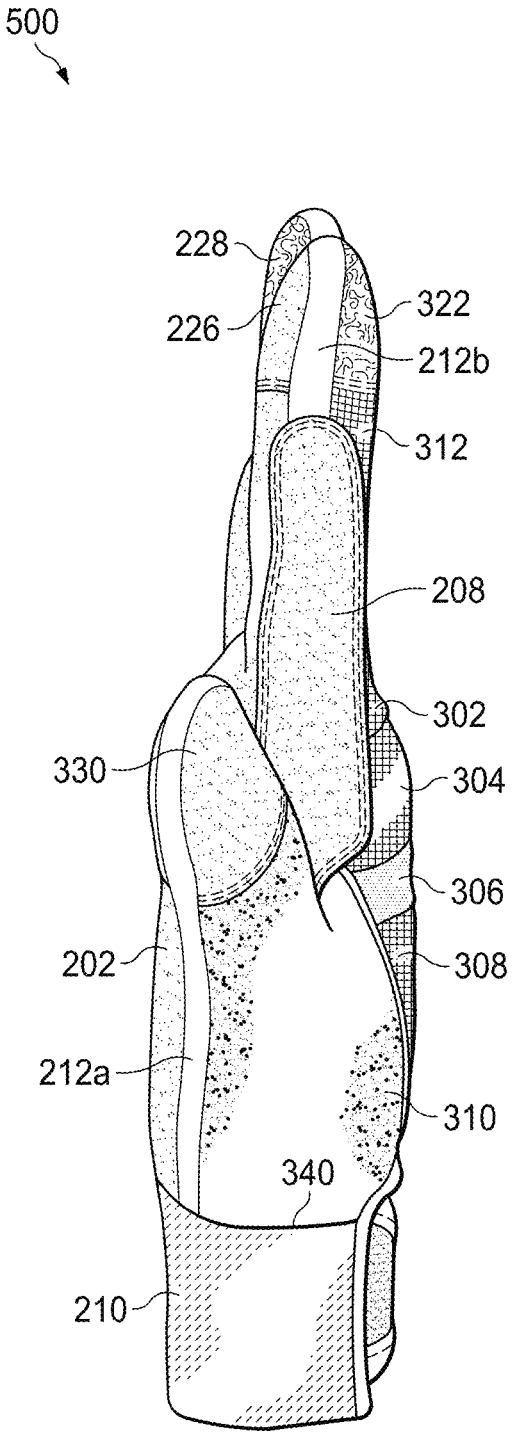
FIG. 5 illustrates an example second-edge view of the glove of FIG. 1.
Figure 6:
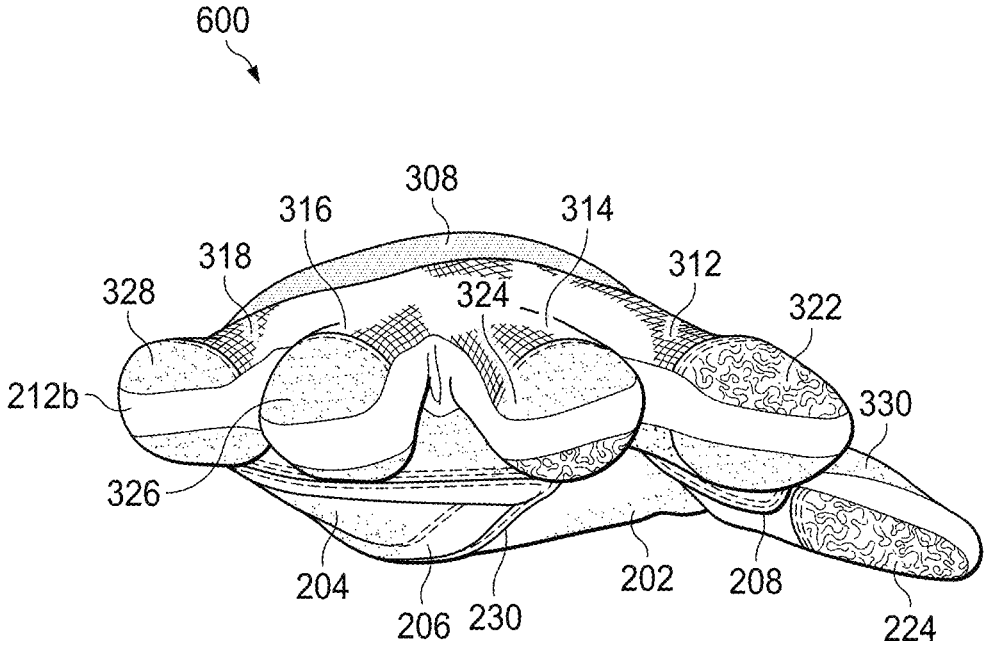
FIG. 6 shows an example top view of the glove of FIG. 1.

FIG. 4 shows a first edge view 400 of the glove 100 while FIG. 5 shows a second edge view 500 of the glove 100. FIG. 6 shows a top view 600 of the glove 100. The various labels shown in FIGS. 4-6 are discussed in connection with FIGS. 1-3.

Figure 7:
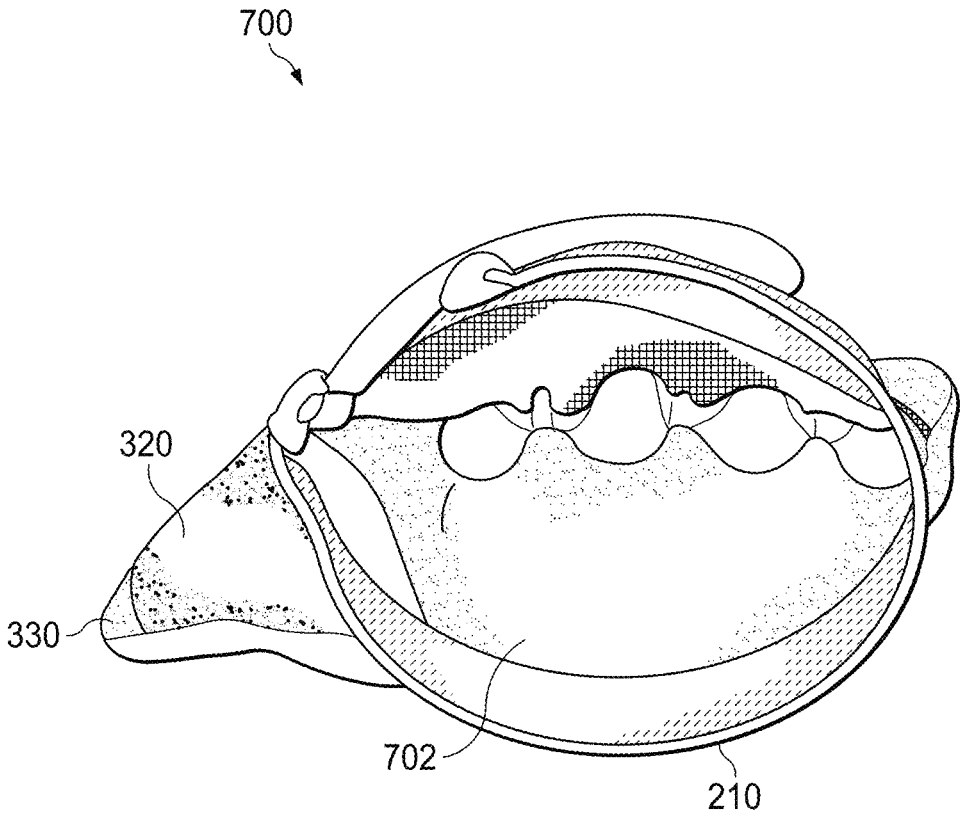
FIG. 7 shows an example bottom view of the glove of FIG. 1.

FIG. 7 depicts a bottom view of the glove 100. As shown in the figure, the glove 100 includes a glove interior 702 into which a user's hand is inserted. In some embodiments, the various parts of the glove 100 are attached within the glove interior 702. The various techniques used to attach the different parts of the glove 100 can be performed within the interior parts of the glove during manufacture in order not to negatively affect the aesthetics of the glove 100 externally. Some of these techniques include single stitching, double stitching, gluing, and/or other forms of coupling, fitting together, and/or securing glove parts to each other. Additionally, the glove interior may include other safety features embedded into the design of the glove 100 that are not visible on the exterior parts of the glove 100. For example, one or more padding portions such as the vibration absorptive padding discussed in association with the hypothenar panel 204, for example, may be fitted to portions within the glove interior 702.

Reference in the specification to "one implementation" or "an implementation" means that a particular feature, structure, or characteristic described in connection with the implementation is included in at least one implementation of the disclosure. The appearances of the phrase "in one implementation," "in some implementations," "in one instance," "in some instances," "in one case," "in some cases," "in one embodiment," or "in some embodiments" in various places in the specification are not necessarily all referring to the same implementation or embodiment.

Finally, the above descriptions of the implementations of the present disclosure have been presented for the purposes of illustration and description. It is not intended to be exhaustive or to limit the present disclosure to the precise form disclosed. Many modifications and variations are possible in light of the above teaching. It is intended that the scope of the present disclosure be limited not by this detailed description, but rather by the claims of this application. As will be understood by those familiar with the art, the present disclosure may be embodied in other specific forms without departing from the spirit or essential characteristics thereof. Accordingly, the present disclosure is intended to be illustrative, but not limiting, of the scope of the present disclosure, which is set forth in the following claims.

What is claimed is:

1. A glove having a palm-side and a back-side joined to the palm-side, the glove comprising:

a thenar panel on the palm-side extending into a thumb finger part, an index finger part, a middle finger part, a ring finger part, and a pinky finger part;

a hypothenar panel on the palm-side including a padded region;

a palm panel on the palm-side bounding the hypothenar panel and the thenar panel;

an edge panel connecting the palm-side to the back-side between the thumb finger part and the index finger part;

a wrist panel attached to a first portion of the palm panel and to a first portion of the thenar panel on the palm-side, at least a section of the wrist panel being attached to a closure element on the back-side of the glove; and a gusset including an expandable material joining the palm-side to the back-side, the gusset being attached on the palm-side to: a first portion of the hypothenar panel, a second portion of the thenar panel, and a second portion of the palm panel.

2. The glove of claim 1, wherein:

the thumb finger part includes a first grip panel on the palm-side, the index finger part includes a second grip panel on the palm-side, and the middle finger part includes a third grip panel on the palm-side.

3. The glove of claim 2, wherein the second grip panel includes a first textured surface that is different from a second textured surface of the first grip panel and is different from a third textured surface of the third grip panel.

4. The glove of claim 2, wherein the second grip panel is configured to be compatible with a capacitive touchscreen.

5. The glove of claim 1, further comprising a palm section at a boundary between the palm panel and the thenar panel, wherein the thenar panel and the palm panel are respectively stitched to the palm section at the boundary.

6. The glove of claim 5, wherein the palm section extends from the wrist panel on the palm-side in a direction of the index finger part and towards a direction of a bottom portion of the pinky finger part.

7. The glove of claim 5, wherein the palm section includes a stretchable material that is different from a first material of the thenar panel and different from a second material of the palm panel.

8. The glove of claim 1, wherein the padded region of the hypothenar panel is configured to absorb vibrations when the glove comes into contact with a vibratory object.

9. A glove having a palm-side and a back-side joined to the palm-side, the glove comprising:

a finger panel on the back-side including:

a first portion with an index finger part, a second portion with a middle finger part, a third portion with a ring finger part, and a fourth portion with a pinky finger part;

a back padding disposed on the back-side and stitched to the finger panel at a first side of the back padding;

a back section on the back-side secured to a second side of the back padding;

a wrist panel including a closure element;

a median panel on the back-side secured to a first side of the back section and to a first section of the wrist panel;

an edge panel connecting the palm-side to the back-side between a thumb finger part and the index finger part; and a pollicis panel providing a fifth portion with the thumb finger part and extending from the back-side to a portion of the palm-side, the pollicis panel being secured to a second section of the wrist panel and to one or more portions of the edge panel.

10. The glove of claim 9, wherein:

the first portion with the index finger part is attached to a first nail panel on the back-side;

the second portion with the middle finger part is attached to a second nail panel on the back-side;

the third portion with the ring finger part is attached to a third nail panel on the back-side;

the fourth portion with the pinky finger part is attached to a fourth nail panel on the back-side; and the fifth portion with the thumb finger part is attached to a fifth nail panel on the back-side.

11. The glove of claim 10, wherein the first nail panel includes a textured surface that is similar to a textured surface of one or more grip panels on the palm-side of the glove.

12. The glove of claim 9, wherein the back section includes stretchable material that is different from:

a first material of the finger panel, a second material of the back padding, a third material of the median panel, and a fourth material of the pollicis panel.

13. The glove of claim 9, wherein the pollicis panel includes a material that is different from a first material of the finger panel.

14. The glove of claim 9, further comprising a first gusset connecting a first portion of the palm-side to the back-side, and a second gusset connecting a second portion of the palm-side to the back-side.

15. The glove of claim 14, wherein the first gusset is attached to a third section of the of the wrist panel and to a first portion of the edge panel, the first gusset being continuous from the third section of the wrist panel to the first portion of the edge panel.

16. The glove of claim 14, wherein the second gusset is attached to a fourth section of the wrist panel and to a second portion of the edge panel, the second gusset being continuous from the fourth section of the wrist panel to the second portion of the edge panel.

17. A glove having a palm-side and a back-side, the glove comprising:

one or more gussets;

an edge panel, the edge panel and the one or more gussets connecting the back-side to the palm-side;

a thenar panel on the palm-side coupled to portions of the one or more gussets and to portions of the edge panel, the thenar panel extending into a thumb finger part, an index finger part, a middle finger part, a ring finger part and a pinky finger part;

a finger panel on the back-side coupled to portions of the one or more gussets and to portions of the edge panel, the finger panel providing a portion with at least one or more of the index finger part, the middle finger part, the ring finger part, and the pinky finger part; and a wrist panel coupled to a portion of the thenar panel on the palm-side and to a closure element at the back-side.

18. The glove of claim 17, wherein a median panel on the back-side is coupled to a first portion of the wrist panel and to a first section of the one or more gussets, the median panel and the finger panel being configured to wick-away moisture from within the glove during use of the glove.

19. The glove of claim 17, further comprising:

a first grip panel at a section of the thumb finger part attached to the thenar panel on the palm-side;

a second grip panel at a section of the index finger part attached to the thenar panel on the palm-side, the second grip panel being configured to be compatible with a capacitive touchscreen; and a third grip panel at a section of the middle finger part attached to the thenar panel on the palm-side, the second grip panel having a textured surface that is different from a first textured surface of the first grip panel, and different from a second textured surface of the third grip panel.

20. The glove of claim 17, further comprising:

a first nail panel attached to a section of the index finger part attached to the finger panel on the back-side;

a second nail panel attached to a section of the middle finger part attached to the finger panel on the back-side;

a third nail panel attached to a section of the ring finger part attached to the finger panel on the back-side; and a fourth nail panel attached to a section of the pinky finger part attached to the finger panel on the back-side.

* * * * *